US007789688B2

(12) United States Patent
Hemmi et al.

(10) Patent No.: US 7,789,688 B2
(45) Date of Patent: Sep. 7, 2010

(54) CONNECTOR

(75) Inventors: Yoshinobu Hemmi, Kyoto (JP); Hirotada Teranishi, Kyoto (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 327 days.

(21) Appl. No.: 11/916,018

(22) PCT Filed: May 23, 2006

(86) PCT No.: PCT/JP2006/310234

§ 371 (c)(1),
(2), (4) Date: Nov. 29, 2007

(87) PCT Pub. No.: WO2006/129521

PCT Pub. Date: Dec. 7, 2006

(65) Prior Publication Data

US 2009/0318001 A1 Dec. 24, 2009

(30) Foreign Application Priority Data

May 31, 2005 (JP) ..... 2005-159583

(51) Int. Cl.
*H01R 13/62* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 5,695,359 A * 12/1997 Fujikura et al. ..... 439/495
5,695,360 A * 12/1997 Seto et al. ..... 439/495
6,533,606 B2 3/2003 Yamane
6,722,905 B2 * 4/2004 Negishi et al. ..... 439/260
6,902,425 B2 * 6/2005 Huang ..... 439/495
7,455,547 B2 * 11/2008 Hemmi et al. ..... 439/495
2002/0081884 A1 * 6/2002 Asai ..... 439/260

FOREIGN PATENT DOCUMENTS

JP 9-92411 4/1997
JP 2683709 8/1997

(Continued)

OTHER PUBLICATIONS

International Search Report w/ English Translation for PCT/JP2006/310234 mailed Aug. 22, 2006 (4 pages).

(Continued)

*Primary Examiner*—Gary F. Paumen
(74) *Attorney, Agent, or Firm*—Osha Liang LLP

(57) ABSTRACT

The present invention provides a connector that has high contact reliability and versatility enabling the reliable electric connection of flexible printed boards with a spread in thickness and flexible printed boards with different thicknesses. In this connector, a wider portion of a connection terminal fixed to a base is lifted with a control lever in which rotatable shafts extending coaxially from end surfaces on both sides are rotatably supported on the base. In particular, bearing grooves extending in the vertical direction are provided at a pair of support clasps that are attached to respective end surfaces on both sides of the base. The rotary shafts of the control lever are mated with, and supported by, the bearing grooves rotatably and slidably in the vertical direction.

4 Claims, 23 Drawing Sheets

FOREIGN PATENT DOCUMENTS

| | | |
|---|---|---|
| JP | 10270130 | 10/1998 |
| JP | 2001126793 | 5/2001 |
| JP | 2002-252061 | 9/2002 |
| JP | 2003-346948 | 12/2003 |
| JP | 2004-63401 | 2/2004 |
| JP | 2004-179500 | 6/2004 |

OTHER PUBLICATIONS

Patent Abstracts of Japan 2004-179500 dated Jun. 24, 2004 (1 page).
Patent Abstracts of Japan 2003-346948 dated Dec. 5, 2003 (1 page).
Patent Abstracts of Japan 2004-063401 dated Feb. 26, 2004 (1 page).
Notification of Transmittal of Copies of Translation of the International Preliminary Report on Patentability (Chapter I or Chapter II of the Patent Cooperation Treaty) for International Application No. PCT/JP2006/310234, mailed on Dec. 21, 2007 (8 pages).
Japanese Office Action for related patent application No. 159583/2005, mailed Mar. 23, 2010, and English translation thereof 5 pages.
English Abstract from espacenet for patent application with Publication No. JP9092411, Publication Date: Apr. 4, 1997, 1 page.
English Abstract from espacenet for patent application with Publication No. JP10270130, Publication Date: Oct. 9, 1998, 1 page.
English Abstract from espacenet for patent application with Publication No. JP2001126793, Publication Date: May 11, 2001, 1 page.

* cited by examiner

CONNECTOR

BACKGROUND OF THE INVENTION

1. Field of the Invention

The present invention relates to a connector, and more particularly to a connector having excellent versatility that can be used for connecting flexible printed boards of various thicknesses.

2. Description of the Related Art

Japanese Patent No. 2,683,709 describes an example of conventional zero insertion force electric connector as a connector for connecting flexible printed boards.

Thus, in this zero insertion force electric connector, a rotary cam member 100 is supported on an insulating housing 4 so that the rotary cam member can rotate about a cylindrical portion 102 as a rotation center. By rotating the rotary cam member 100, part of a terminal 150 is lifted and then a flat flexible cable FFC is inserted. Then, the rotary cam member 100 is rotated in the opposite direction and a load applied to the terminal 150 is released, whereby the flat flexible cable FFC is sandwiched by the terminal 150, ensuring electric connection However, with the above-described zero insertion force electric connector, the rotation center of the cylindrical portion 102 of the rotary cam member 100 is fixed and cannot shift in the vertical direction. For this reason, when a printed board with a thickness larger than that of the flexible printed board having a predetermined thickness is inserted, the control level cannot completely return to the original position in which it produces no effect on the terminal 150. As a result, a state is assumed in which the terminal 150 remains partially pulled up by the rotary cam member 100, and the desired contact pressure cannot be ensured. Therefore, because printed boards of different thicknesses cannot be connected, the versatility is low. Further, even with the flexible printed boards of the same thickness specifications, usually there is a large spread in thickness between the resin flexible printed boards, the drawbacks similar to those described above easily occur, and the contact reliability is low.

SUMMARY OF THE INVENTION

With the foregoing in view, it is an object of the present invention to provide a connector that has high contact reliability enabling the reliable electric connection of flexible printed boards with a spread in thickness and also has high versatility making it possible to connect electrically flexible printed boards with different thicknesses.

The connector in accordance with the present invention that resolves the above-described problems has a configuration in which one end of a connection terminal fixed to a base is lifted with a control lever in which rotatable shafts extending coaxially from end surfaces on both sides are rotatably supported on the base, wherein bearing grooves extending in the vertical direction are provided in extending portions that extend from end surfaces on both sides of the base, and the rotary shafts of the control lever are mated with, and supported by, the bearing grooves rotatably and slidably in the vertical direction.

Further, the connector in accordance with the present invention may have a configuration in which one end of a connection terminal fixed to a base is lifted with a control lever in which rotatable shafts extending coaxially from end surfaces on both sides are rotatably supported on the base, wherein bearing grooves extending in the vertical direction are provided at a pair of support clasps that are attached to respective end surfaces on both sides of the base, and the rotary shafts of the control lever are mated with, and supported by, the bearing grooves rotatably and slidably in the vertical direction.

In accordance with the present invention, where flexible printed boards of different thicknesses are inserted, the rotary shafts of the control lever slide in the vertical direction correspondingly to the thickness of the printed board. Therefore, the control lever can completely return to a position in which it is not brought into contact under pressure with the connection terminals. As a result, because no effect is produced on the contact pressure of the connection terminals, a connector is obtained that has high versatility and can connect flexible printed boards of different thicknesses. Further, even when there is a spread in thickness dimension of flexible boards, because the rotary shafts of the control lever slide in the vertical direction and no effect is produced on the contact pressure of the connection terminals, in the same manner as described above, a connector with high connection reliability is obtained.

As an embodiment of the present invention, a soldering portion may be provided at the rear end of the extending portion that extends from a distal end portion of the support clasp via a connection portion, and a locking protrusion by which a locking hook portion of the control lever is locked may be provided at the distal end of the extending portion.

With this embodiment, the distance from the soldering portion to the locking protrusion is increased. As a result, even when the soldering portion is soldered to the printed board, the molten solder flow does not adhere to the locking protrusion and does not inhibit the operation of the control lever.

As another embodiment of the present invention, a locking hook portion extending from a metal core of the control lever that is insert molded can be locked by a locking protrusion of the support clasp.

The effect attained in this embodiment is that the metal core of the control lever functions not only as a reinforcing material, but also as a magnetic shield.

DESCRIPTION OF THE PREFERRED EMBODIMENTS

An embodiment of the connector in accordance with the present invention will be described below with reference to the appended drawings (FIG. 1 through FIG. 23).

Figure 1:
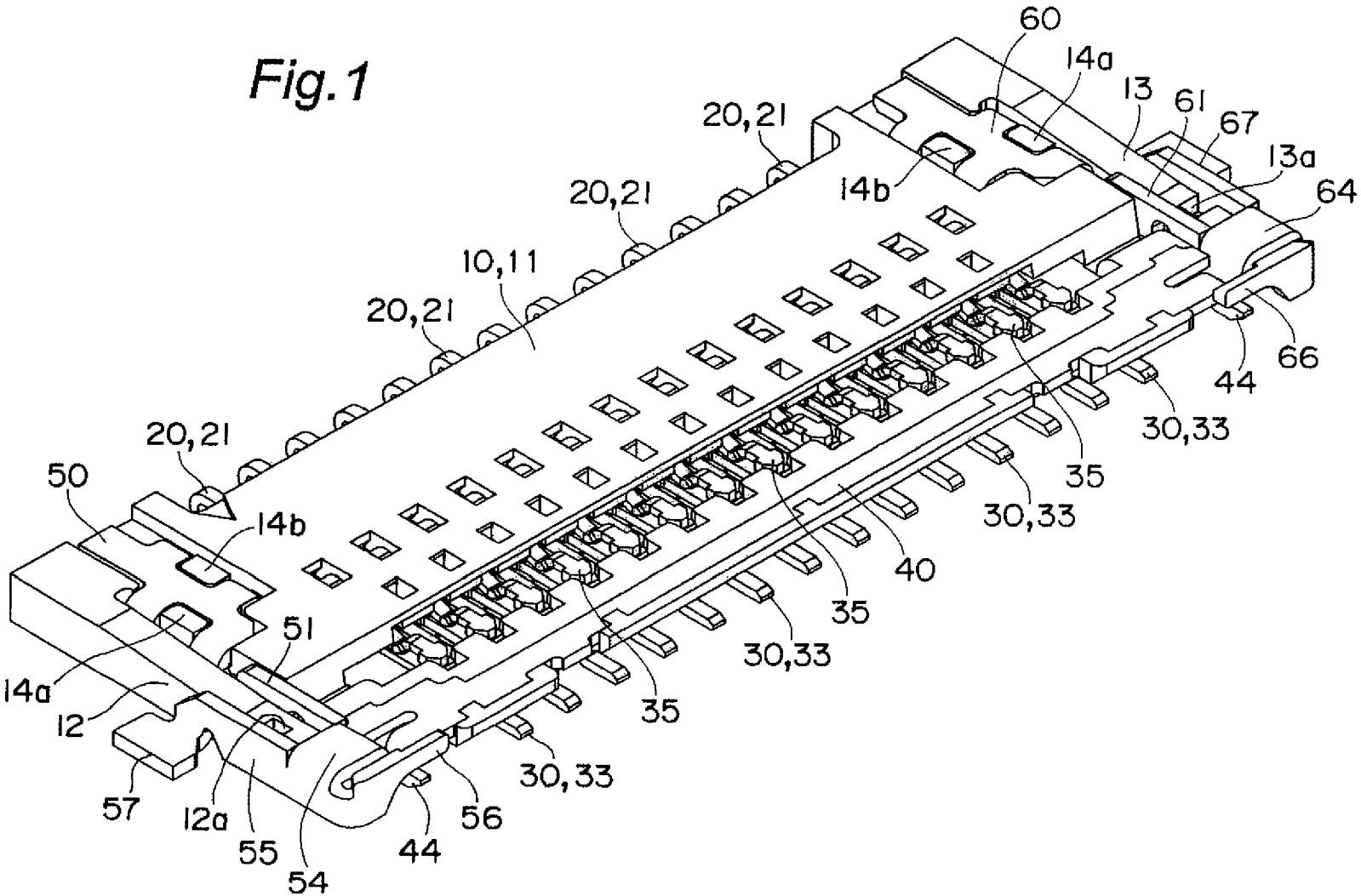
FIG. 1 is a perspective view illustrating an embodiment of the connector in accordance with the present invention.
Figure 2:
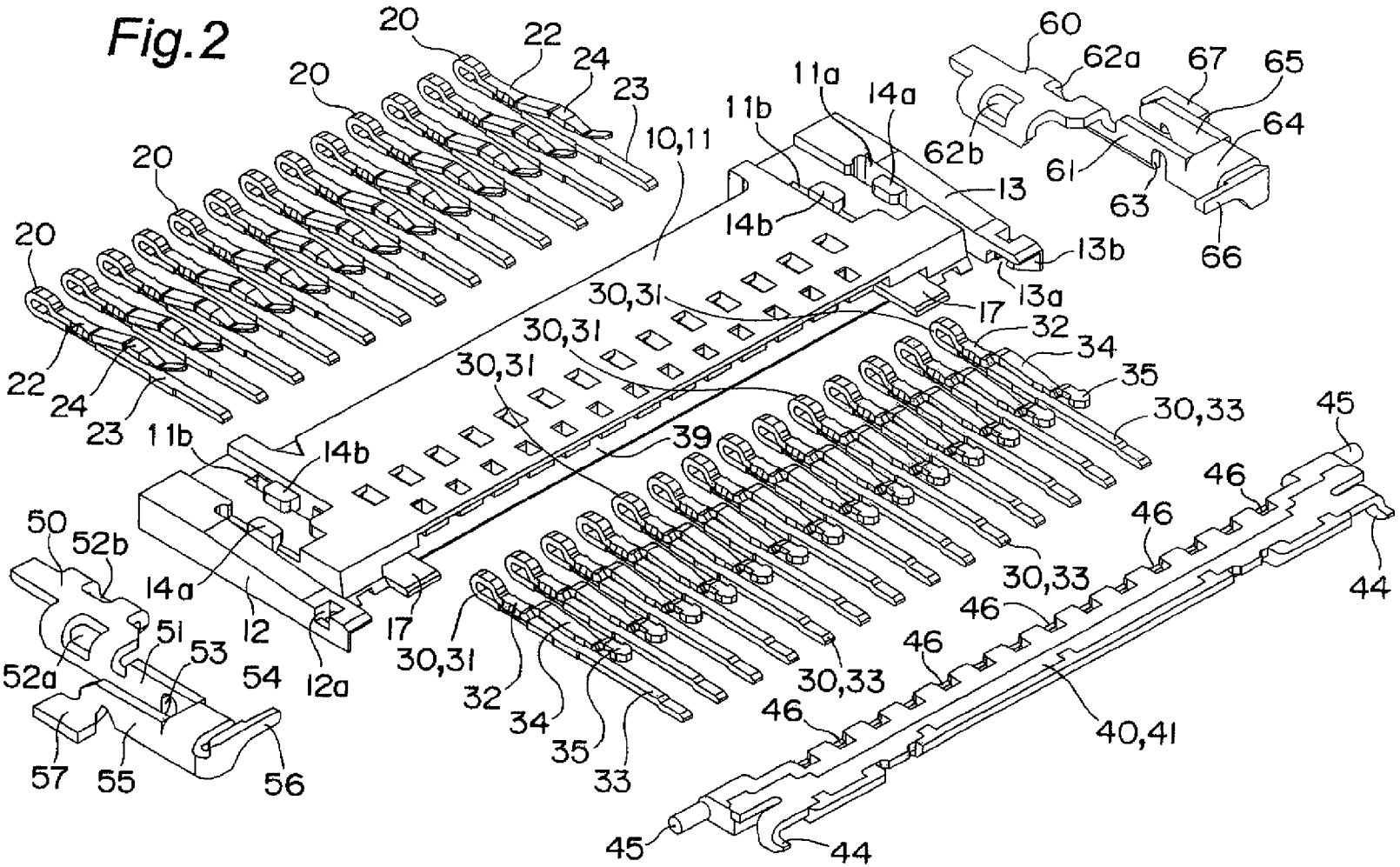
FIG. 2 is an exploded perspective view of the connector shown in FIG. 1.

As shown in FIG. 1 and FIG. 2, the connector of the present embodiment in general comprises a base 10, a first connection terminal 20, a second connection terminal 30, a control lever 40, and support clasps 50, 60.

The maximum height of the connector of the present embodiment is 0.50 mm, the maximum width is 4.65 mm, and the maximum length is 13.20 mm.

Figure 5A:
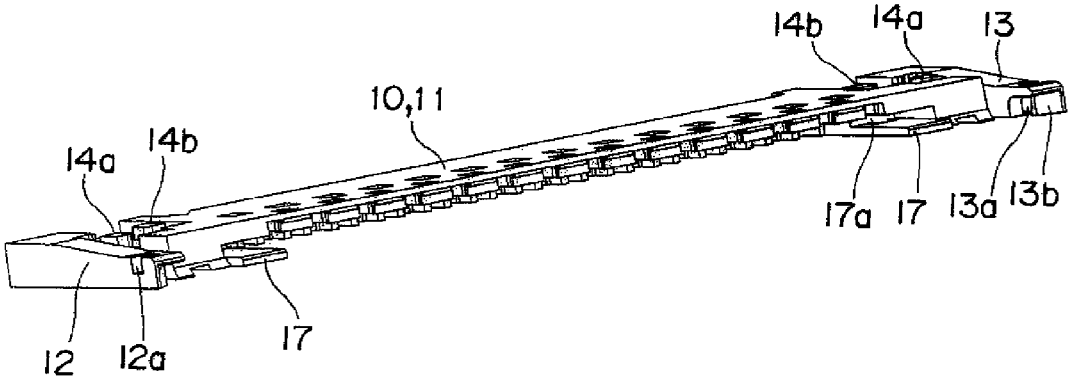
FIG. 5A and FIG. 5B are a perspective view and a partial enlarged view, from a different angle, of the base shown in FIG. 2.
Figure 5B:
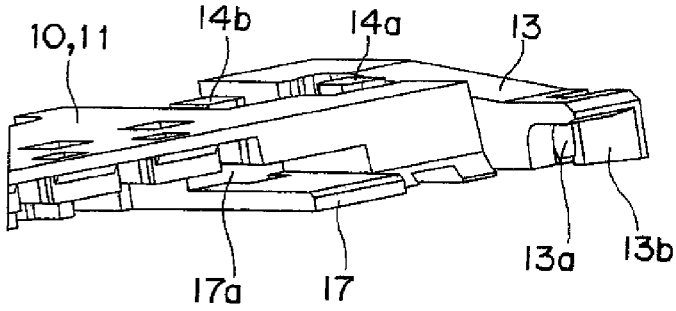
Figure 6A:
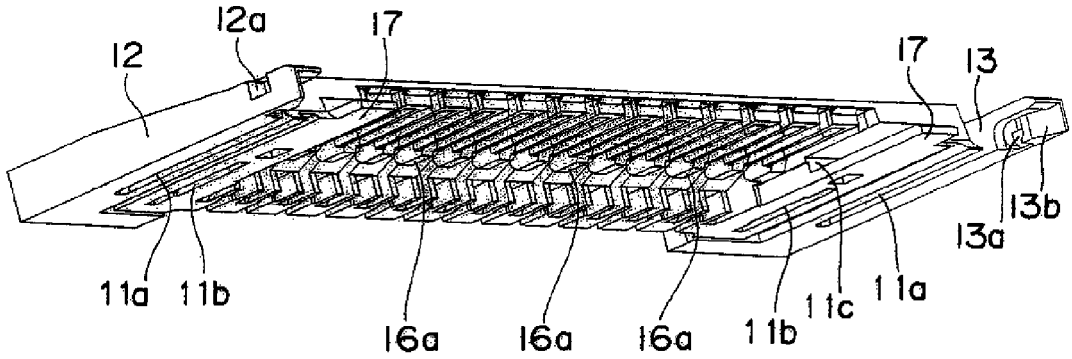
FIG. 6A and FIG. 6B are a perspective view and a partial enlarged view, from another angle, of the base shown in FIG. 2.
Figure 6B:
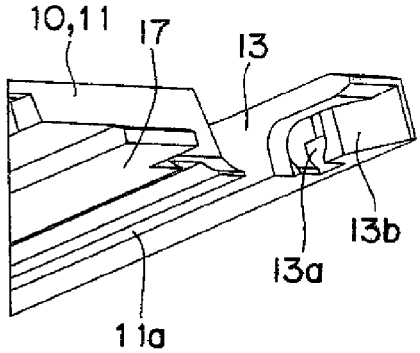

As shown in FIG. 4 through FIG. 8, in the base 10, first engagement slits 11*a*, 11*a* are formed by extending elastic arm portions 12, 13 parallel to each other in the same direction from an edge portion on one side of both side end surfaces of a base body 11. Further, as shown in FIG. 4 through FIG. 7, second engagement slits 11*b*, 11*b* are formed in the vicinity of the two side end surfaces in the base body 11. Further, engagement protrusions 14*a*, 14*b* are provided in a protruding condition, so as not to face each other, at side surfaces adjacent to the first and second slits 11*a*, 11*b*. Positioning concavities 15, 16 that serve to mate with the below-described first and second connection terminals 20, 30 and position the terminals are provided alternately in a zigzag fashion on the rear surface of the base body 11. Further, as shown in FIG. 5 and FIG. 6, a reference surface 17*a* for position control is formed at the farther side of a guide tongue piece 17 that protrudes forward from the rear surface of the base 10. On the other hand, rotary shafts 45, 45 of the below-described control lever 40 are rotatably supported on the distal end portions of the elastic arm portions 12, 13, and respective thrust bearing portions 12*a*, 13*a* are formed. Further, taper surfaces 12*b*, 13*b* are formed at the distal end surfaces of the elastic arm portions 12, 13, respectively.

Figure 9A:
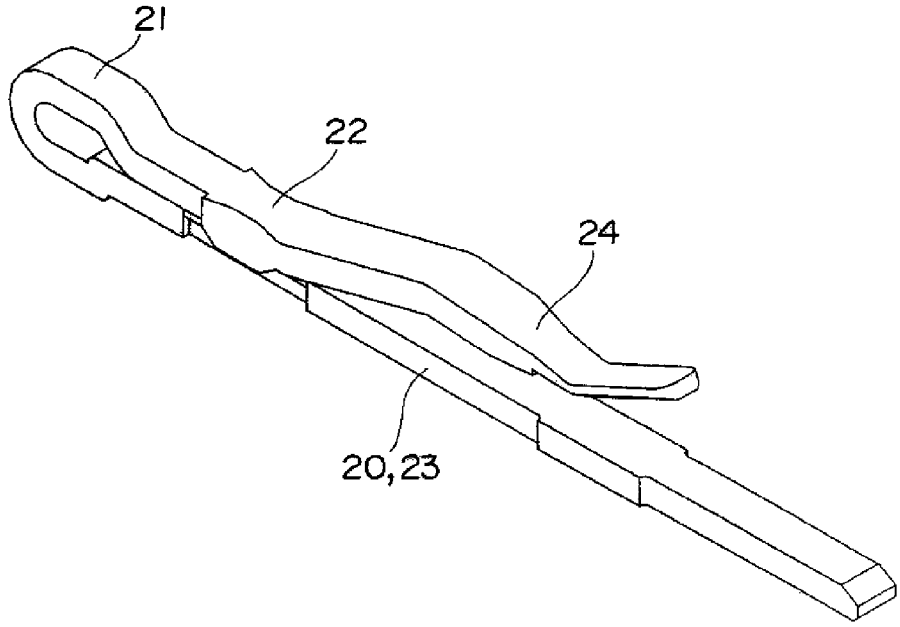
FIG. 9A and FIG. 9B are a perspective view and a front view of the first connection terminal shown in FIG. 2.
Figure 9B:
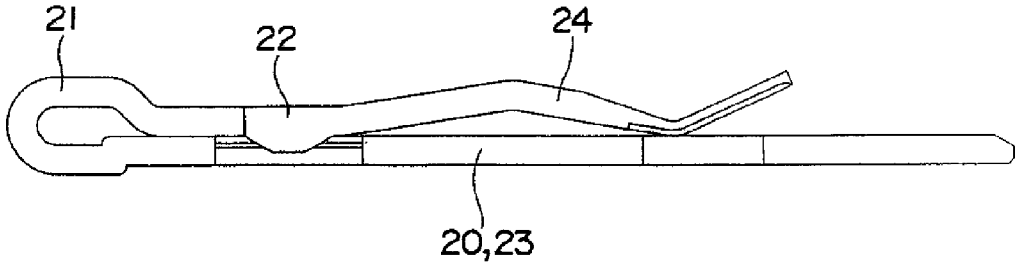
Figure 15A:
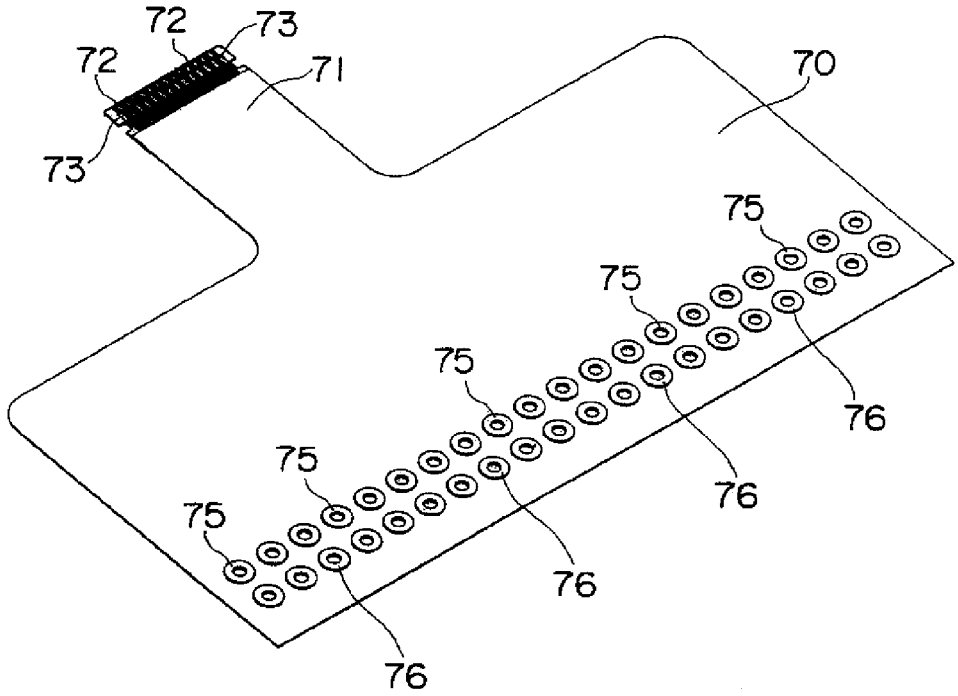
FIG. 15A and FIG. 15B are a perspective view and a partial enlarged perspective view of the flexible printed board.
Figure 15B:
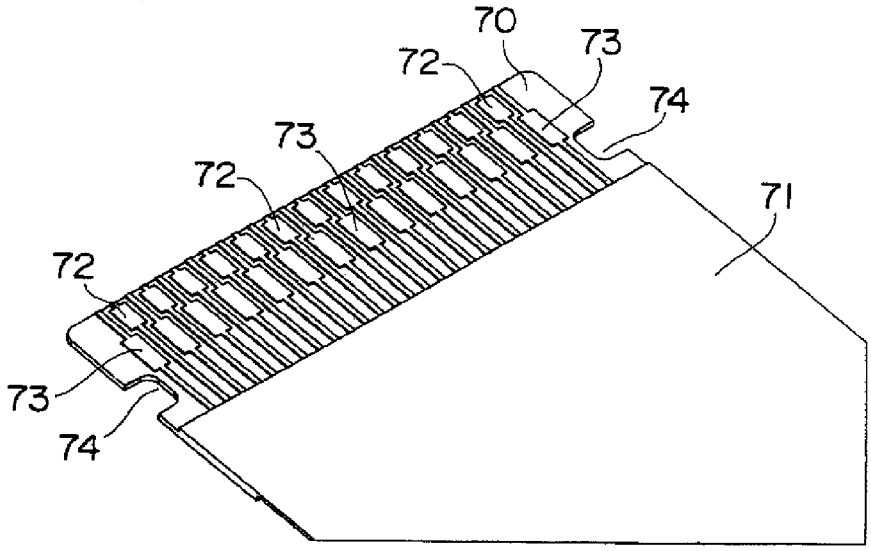
Figure 16A:
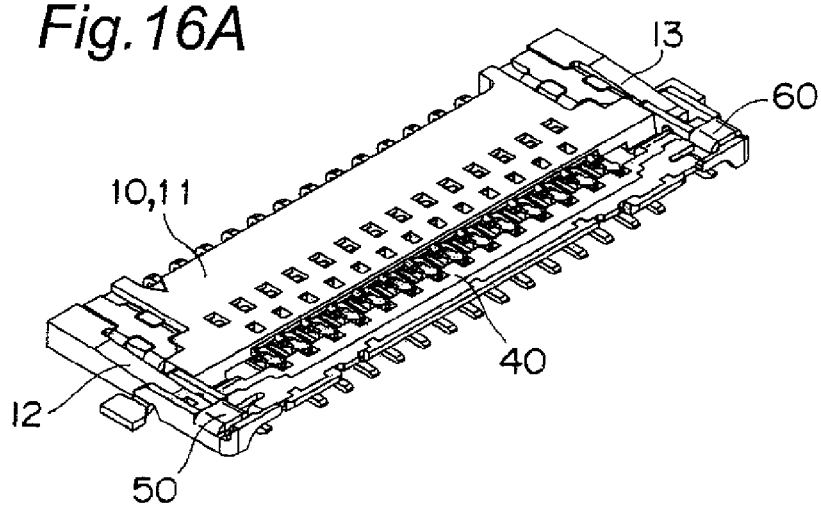
FIG. 16A, FIG. 16B and FIG. 16C is a perspective view before the operation of the connector, a perspective view during the operation, and a perspective view immediately before the flexible printed board is inserted.
Figure 16B:
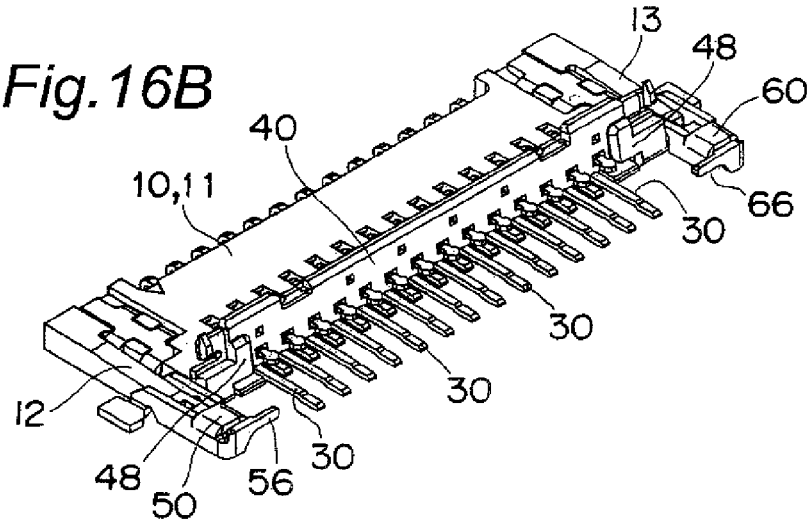
Figure 16C:
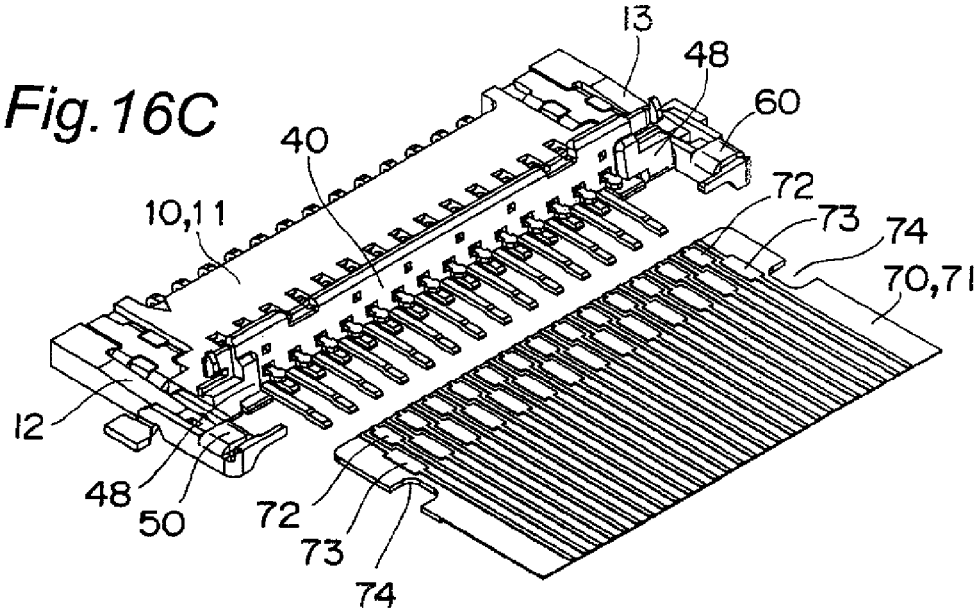

As shown in FIG. 9, the first connection terminal 20 is connected to the first conductive portion 72 provided at one end edge of the below-described flexible substrate 70 (FIG. 15). For this purpose, a needle-shaped metal member that is punched out from a band-shape thin metal sheet is bent in two, and a zone close to a bent portion 21 is fixed by caulking to obtain a rotation fulcrum 22, whereby a movable contact piece 24 having a predetermined spring force is formed at a terminal body portion 23. As a result, in the first connection terminal 20, the first conductive portion 72 of the flexible printed board 70 can be sandwiched by the terminal body portion 23 and the movable contact piece 24.

Figure 10A:
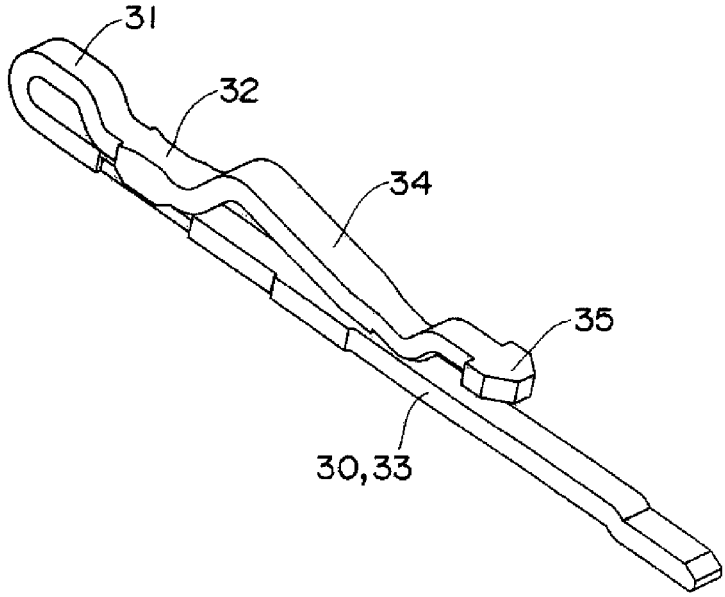
FIG. 10A, FIG. 10B and FIG. 10C are a perspective view, a front view, and a plan view of the second terminal shown in FIG. 2.
Figure 10B:
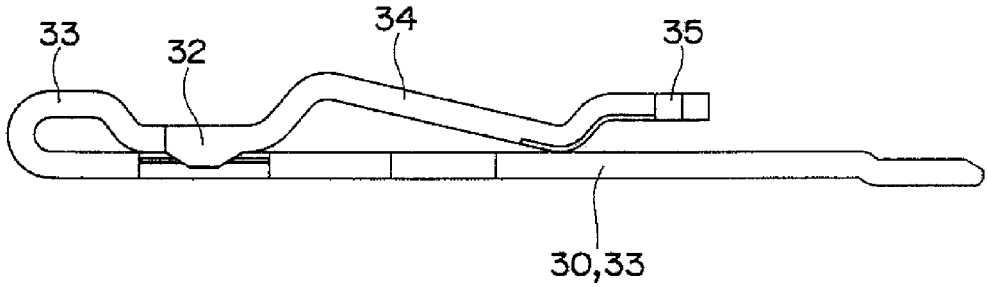
Figure 10C:
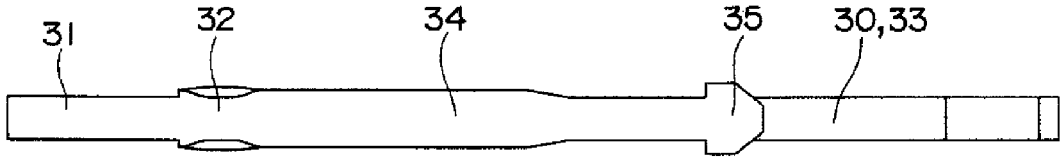

Likewise, as shown in FIG. 10, the second connection terminal 30 is connected to a second conductive portion 73 positioned in the vicinity of the distal end edge of the below-described flexible printed board 70 (FIG. 15). For this reason, a needle-shaped metal member that is punched out from a band-shape thin metal sheet is bent in two, and a zone close to a bent portion 31 is fixed by caulking to obtain a rotation fulcrum 32, whereby a movable contact piece 34 having a predetermined spring force is formed at a terminal body portion 33. As a result, in the second connection terminal 30, the second conductive portion 73 of the flexible printed board 70 can be sandwiched by the terminal body portion 33 and the movable contact piece 34.

The distal end portion of the movable contact piece 34 reliably abuts against a cam portion 46 of the below-described control lever 40 (FIG. 11), and serves as a wider portion 35 of a plane, almost trapezoidal shape so as to prevent the occurrence of twisting. In particular, the wider portion 35 forms taper surfaces on both sides at the distal end. The resultant advantage is that the movable contact piece 34 of the second connection terminal 30 can be smoothly inserted into an insertion hole 47 of the control lever 40.

Figure 7A:
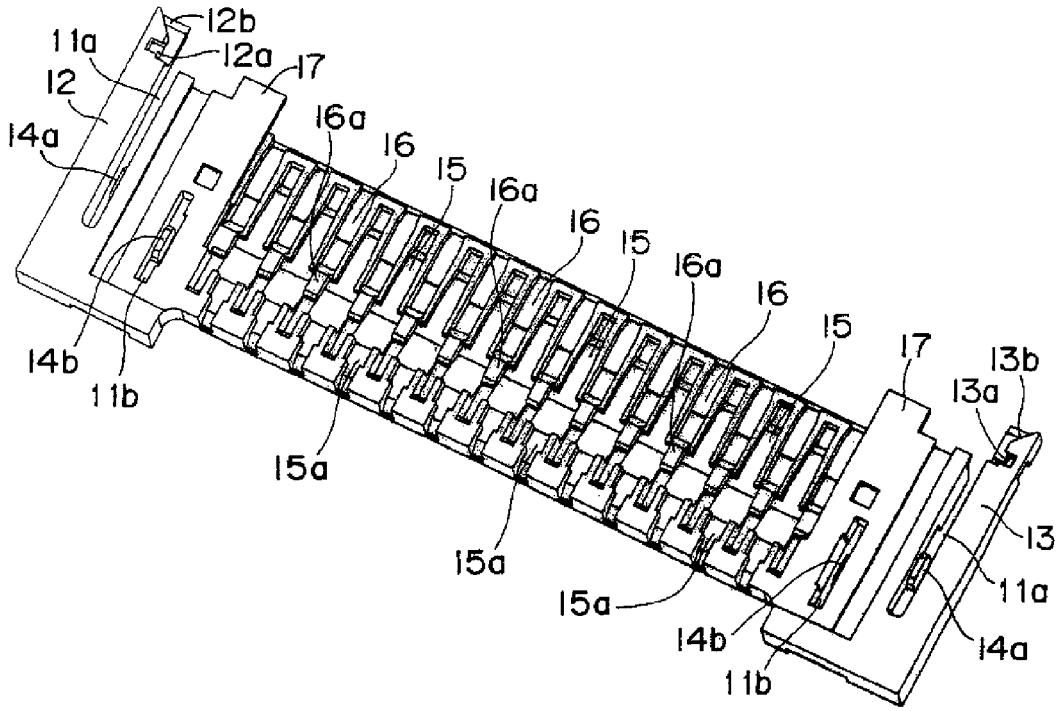
FIG. 7A, FIG. 7B and FIG. 7C are a perspective view and partial enlarged views from below of the base shown in FIG. 2.
Figure 7B:
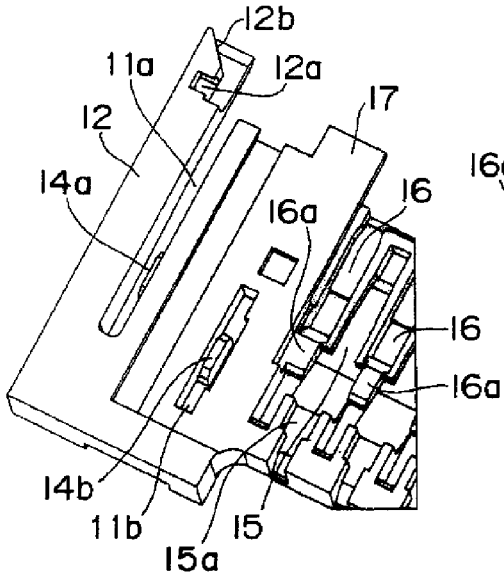
Figure 7C:
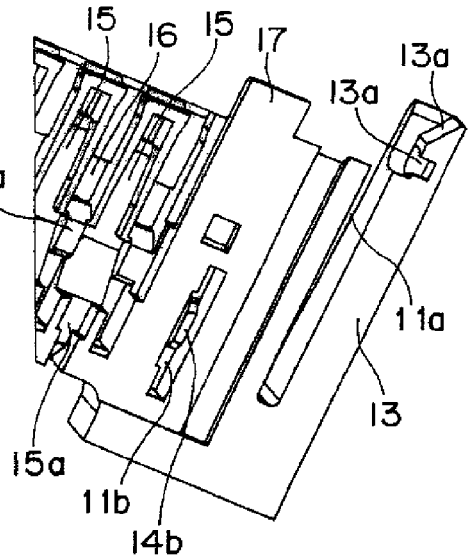
Figure 8A:
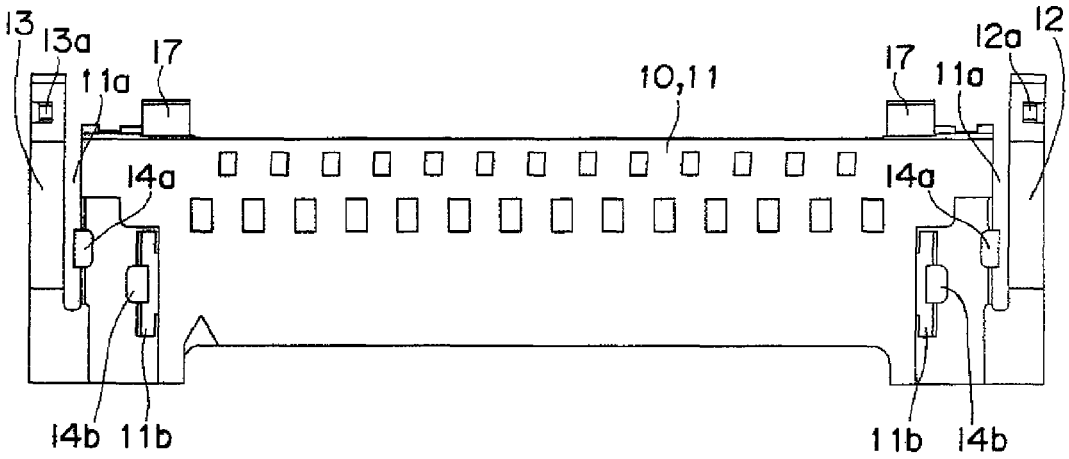
FIG. 8A and FIG. 8B are a plan view and a partial enlarged perspective view of the base shown in FIG. 2.
Figure 8B:
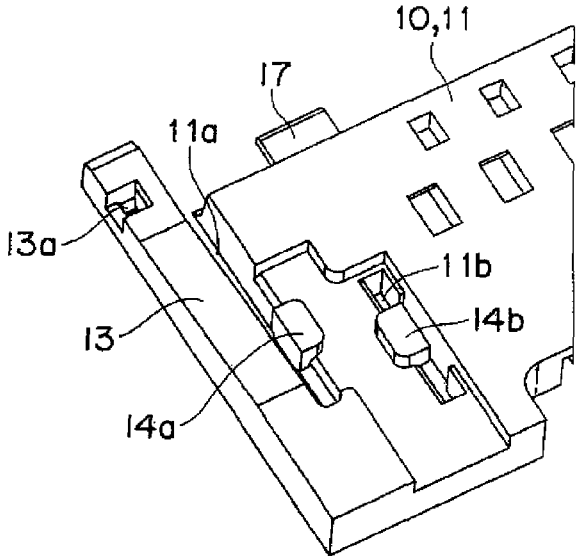

The first and second connection terminals 20, 30 are mated with and positioned by guide concavities 15, 16, respectively, that are formed in the rear surface of the base 10. Further, the second connection terminals are fixed to the base 10 by heating and fusing a pressure-sensitive adhesive tape to the rear surface of the base 10. At this time, as shown in FIG. 7, of the back surface of the base 10, a reference surface 15*a* for positioning that is formed in the position corresponding to the rotation fulcrum 22 of the first connection terminal 20 positions the first connection terminal 20, and a positioning protrusion 16*a* that is provided in a protruding condition in a position corresponding to the rotation fulcrum 32 of the second terminal 30 positions the second terminal 30. The resultant advantage is that the assembling accuracy is high.

Figure 11A:
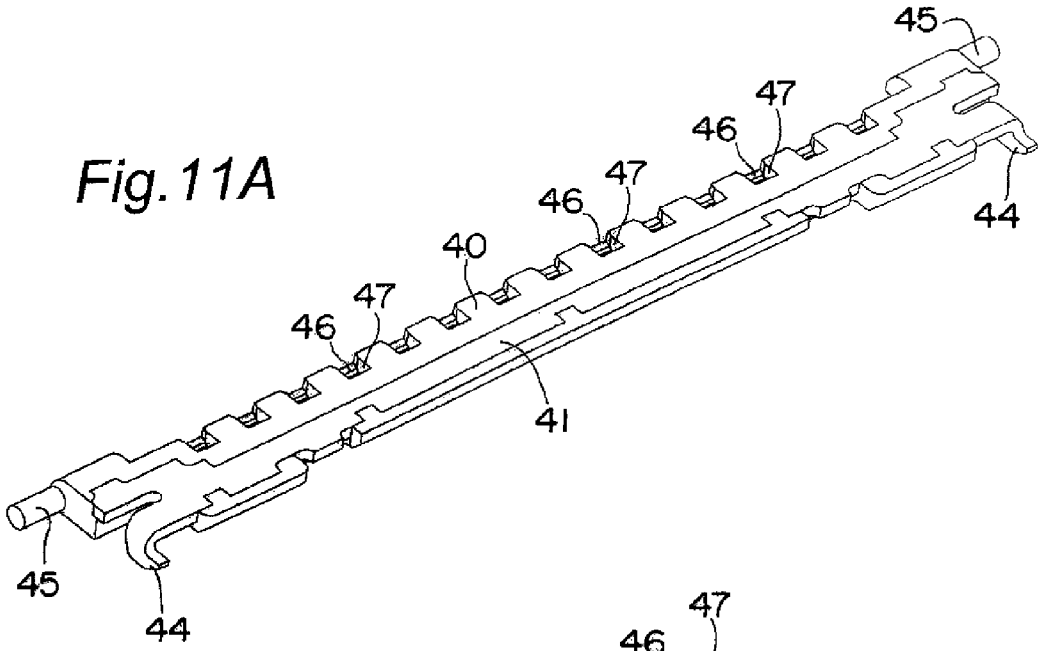
FIG. 11A, FIG. 11B and FIG. 11C are a perspective view, a partial enlarged perspective view, and an enlarged left-side view of the control lever shown in FIG. 2.
Figure 11B:
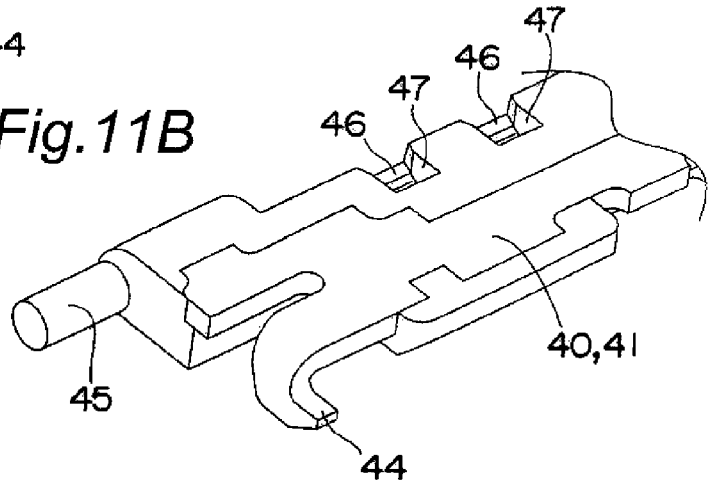
Figure 11C:
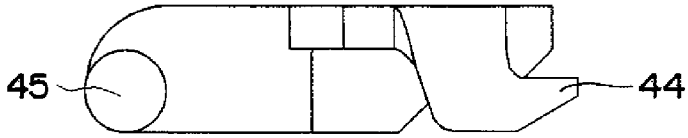
Figure 12A:
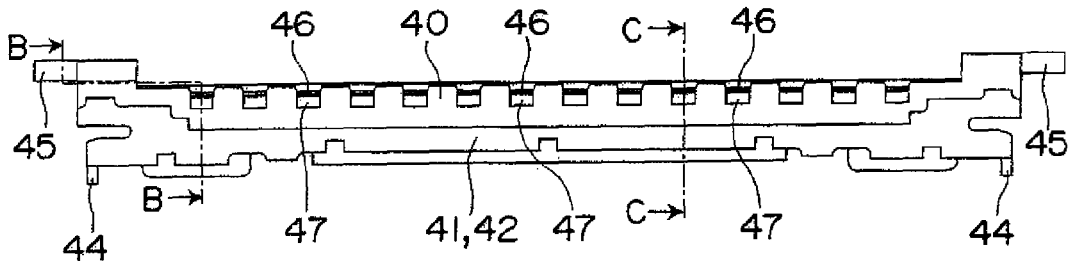
FIG. 12A, FIG. 12B and FIG. 12C are a plan view of the control lever shown in FIG. 11, and a cross-sectional view along a B-B line and a cross-sectional view along a C-C line in FIG. 12A.
Figure 12B:
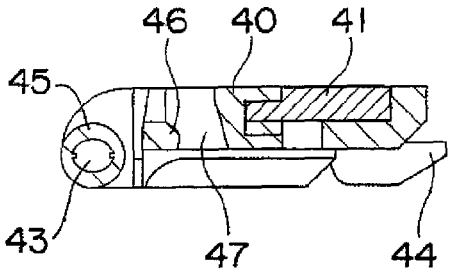
Figure 12C:
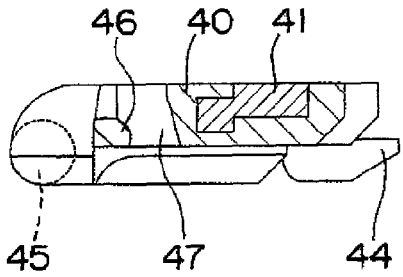
Figure 13A:
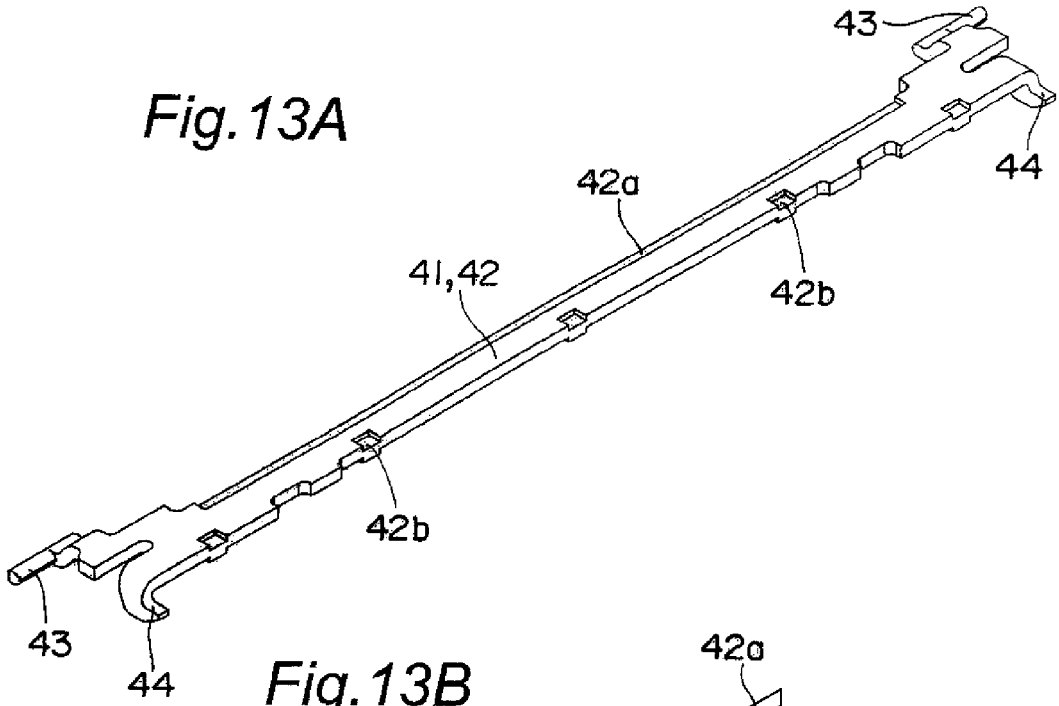
FIG. 13A, FIG. 13B and FIG. 13C are a perspective view, a partial enlarged perspective view, and an enlarged left-side view of the core of the control lever shown in FIG. 11.
Figure 13B:
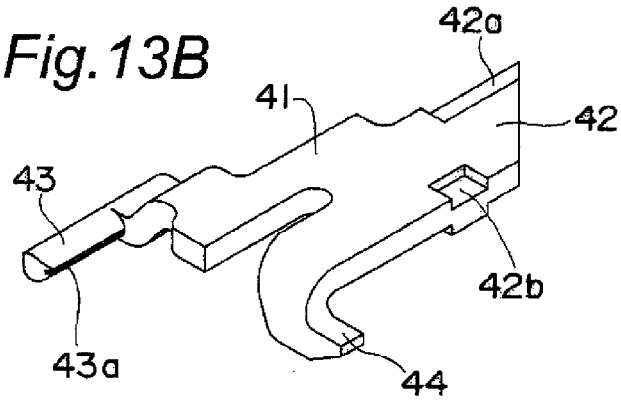
Figure 13C:
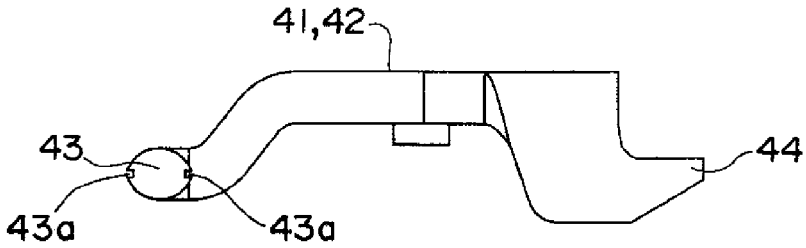

The control lever 40, as shown in FIG. 11 through FIG. 13, is manufactured by insert molding a metal core 41. As shown in FIG. 13, the core 41 is punched and pressed from a sheet-like metal material, and an axial core portion 43 that serves as the below-described rotary shaft 45 and a hook portion 44 for locking are formed at respective ends of a core body 42. In particular, the axial core portion 43 is pressed to produce a substantially round cross section from a square cross section. The resultant advantage is that the number of production operations is small and the rotary shaft 45 with a high position accuracy can be obtained. However, in order to prevent the molded resin from peeling, a pair of fine grooves 43*a* are lefts these grooves facing the outer circumferential surface of the axial core portion 43. This is done to improve the flow or resin and prevent the molded resin from peeling. In addition, in order to increase the rigidity of the core body 42, a reinforcing step 42*a* is formed continuously along edge portion of one side thereof. Further, in order to prevent the molded resin from peeling from the core body 42, a plurality of steps 42*b* for peeling prevention are provided with a predetermined pitch at the edge portion of the remaining side.

Figure 3A:
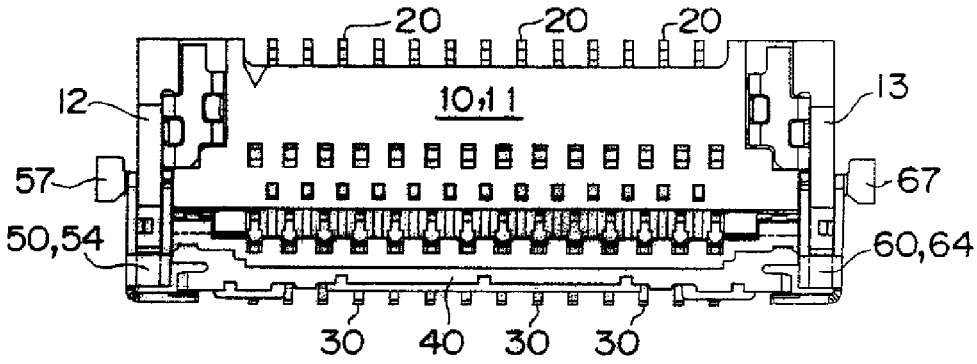
FIG. 3A, FIG. 3B and FIG. 3C are a plan view, a bottom view, and a partial enlarged bottom view of the connector shown in FIG. 1.
Figure 3B:
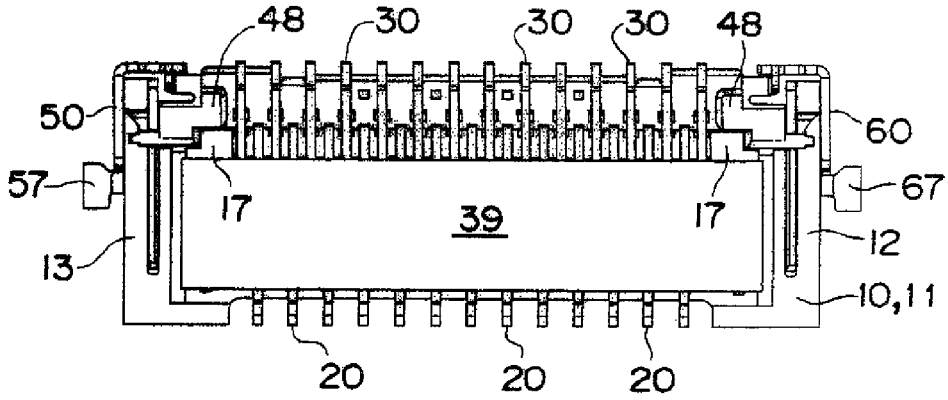
Figure 3C:
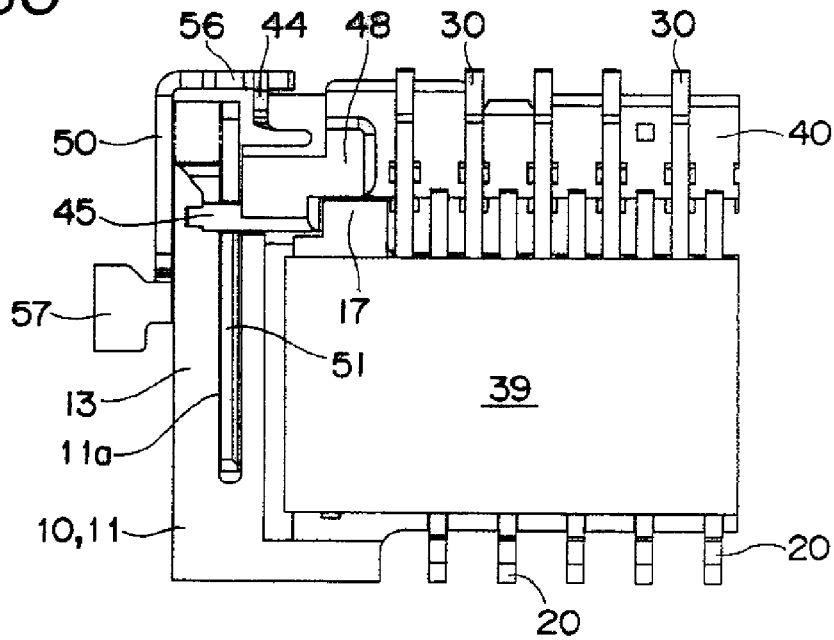
Figure 4A:
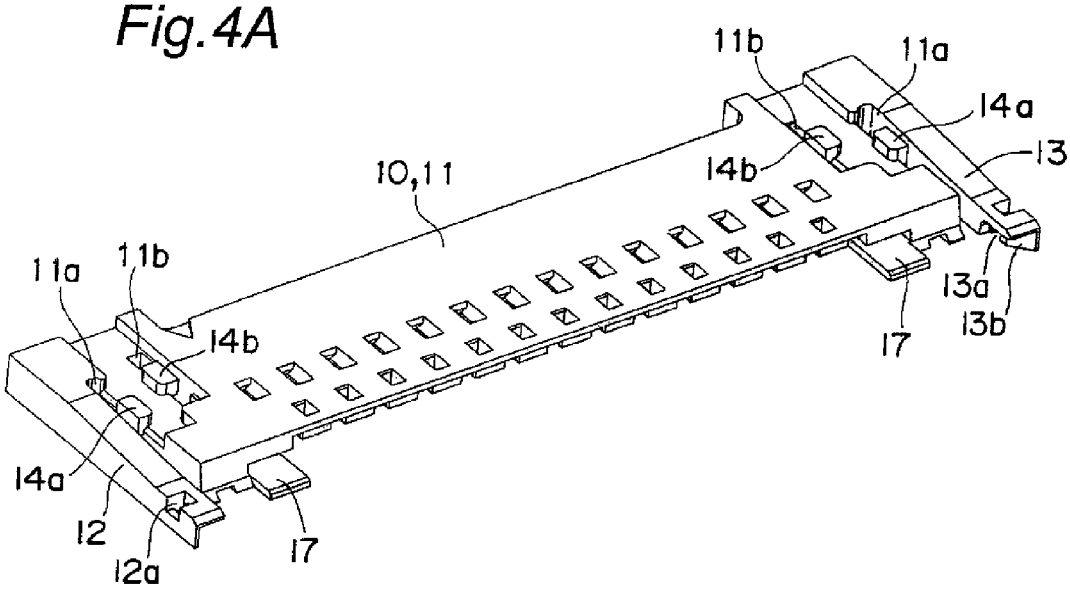
FIG. 4A and FIG. 4B are a perspective view and a partial enlarged view of the base shown in FIG. 2.
Figure 4B:
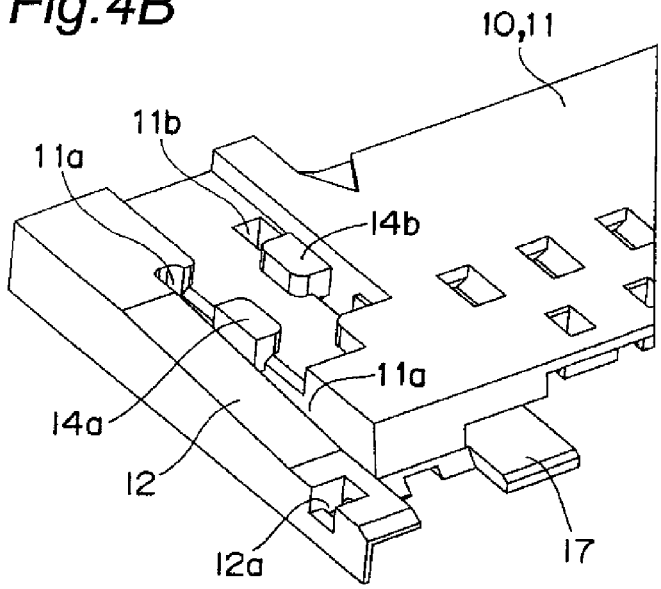
Figure 19A:
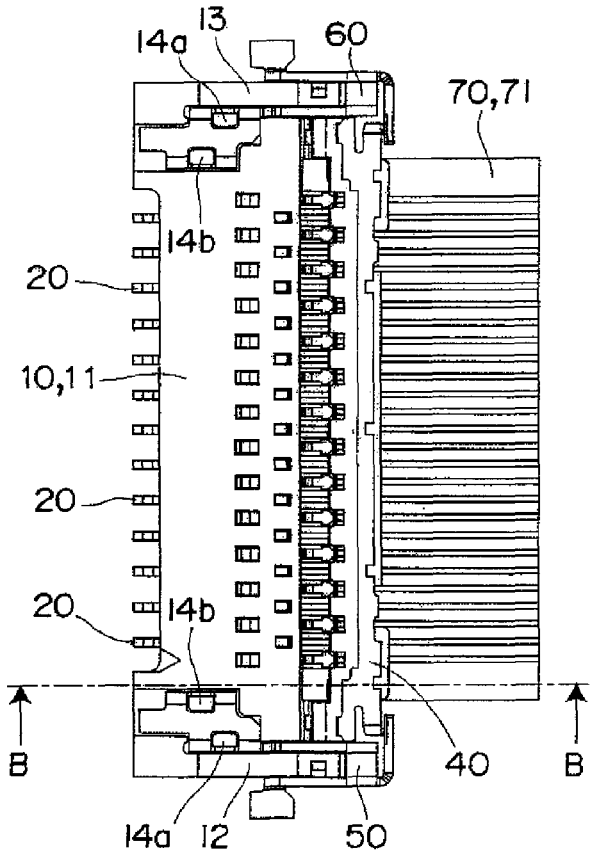
FIG. 19A and FIG. 19B is a plan view illustrating the state in which the control lever is locked and a cross-sectional view along a B-B line in FIG. 19A.
Figure 19B:
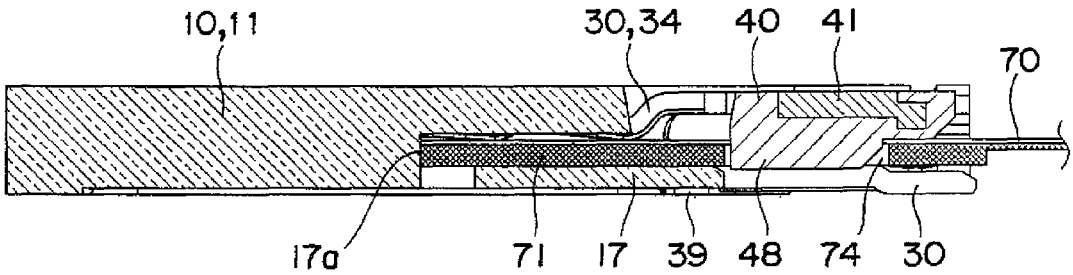

Further, as shown in FIG. 11, by insert molding the core 41, the axial core portion 43 is covered with the molded resin and a rotary shaft 45 of a round cross section is obtained. Further, the core body 42 is covered with the molded resin, and an insertion hole 47 partitioned by a cam portion 46 is formed. In this case, the rotary shaft 45 and the cam portion 46 are located in concentric positions, rather that on the same axis. Further, as shown in FIG. 3C and FIG. 19B, blocking protrusions 48 that will engage with notched portions 74 of the below-described flexible printed substrate 70 are integrally molded at both side end portions of the back surface of the control lever 40.

Further, the rotary shafts 45, 45 of the control lever 40 are pushed against the taper surfaces 12*b*, 13*b* (FIG. 7A) formed at the elastic arm portions 12, 13 of the base 10, and the elastic arm portions 12, 13 are spread. The rotary shafts 45, 45 are then engaged with the bearing portions 12*a*, 13*a* of the elastic arm portions 12, 13, thereby rotationally supporting the control lever 40.

Figure 14A:
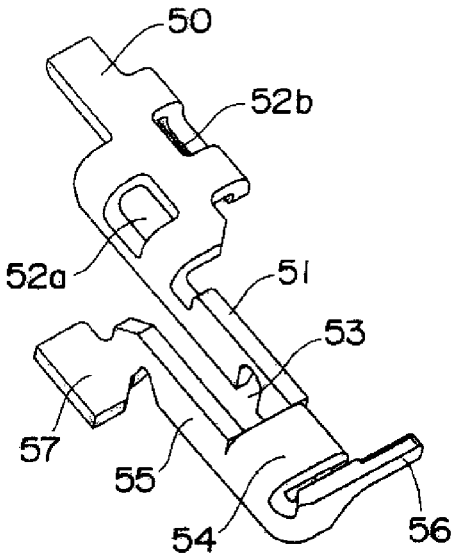
FIG. 14A, FIG. 14B and FIG. 14C are a perspective view and a plan view of the support clasp shown in FIG. 2.
Figure 14B:
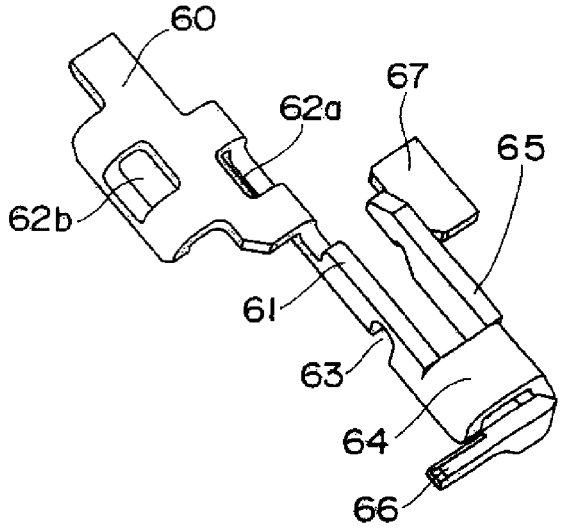

As shown in FIG. 14A and FIG. 14B, the support clasps 50, 60 have shapes that are axially symmetrical with respect to each other and are engaged with and fixed to the base 10. The support clasps 50, 60 rotatably support the control lever 40 and are used when the base 10 is fixed to a printed substrate (not shown in the figure).

Thus, the support clasp 50 (60) is provided with a pair of engagement holes 52*a*, 52*b* (62*a*, 62*b*) that can engage respectively with the engagement protrusions 14*a*, 14*b* of the base at one end side of a support clasp body 51 (61), and an extension portion 55 (65) is formed via a joining portion 54 (64) at the other end side. The extension portion 55 (65) has a locking protrusion 56 (66) provided in a protruding condition at one end thereof that is positioned in the vicinity of the joining portion 54 (64), and a soldering portion 57 (67) is formed at the other end thereof.

Further, the support clasps 50, 60 are fixed by engaging the engagement holes 52*a*, 52*b*, 62*a*, 62*b* thereof with respective engagement protrusions 14*a*, 14*b* of the base 10. As a result, the rotary shafts 45, 45 of the control lever 40 are fitted, so that they can slide in the vertical direction, into the bearing grooves 53, 63 and are rotatably supported therein. The locking hook portions 44, 44 of the control lever 40 can be locked with respective locking protrusions 56, 66 of the support clasps 50, 60.

The support clasps 50, 60 of the present embodiment are provided in positions such that the soldering portions 57, 67 and locking protrusions 56, 66 are separated from each other. For this reason, even when the soldering portions 57, 67 are soldered to the printed substrate, the molten solder is prevented from flowing and adhering to the locking protrusions 56, 66. Further, in the present embodiment, the support clasp bodies 51, 61 and extending portions 55, 65 are joined by wide joining portions 54, 64 and rigidity thereof is increased. Because of this, an external force applied to the bearing grooves 53, 63 via the rotary shaft 45 is dispersed via the joining portions 54, 64 and, therefore, the support clasps 50, 60 are prevented from being deformed when the flexible printed board 70 is pulled or rotated.

Figure 14C:
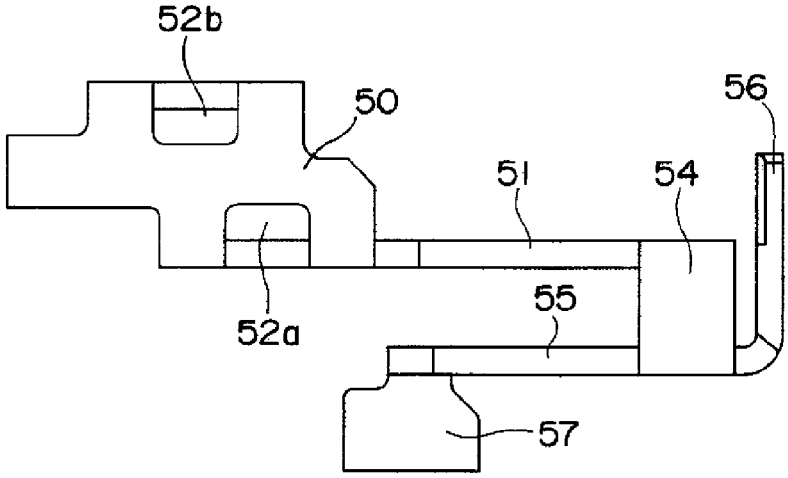

In the flexible printed board 70, as shown in FIG. 14, the first and second conductive portions 72, 73 are provided side by side alternately in a zigzag fashion at the edge portion of the distal end of the insertion portion 71 positioned at one end side of the flexible printed board. At the edge portion at the other end of the flexible printed board 70, there are provided two rows of first and second connection pads 75, 76 that are electrically connected via printed wiring (not shown in the figure) to the first and second conductive portions 72, 73.

A method for using the connector of the present embodiment will be described below.

Figure 20A:
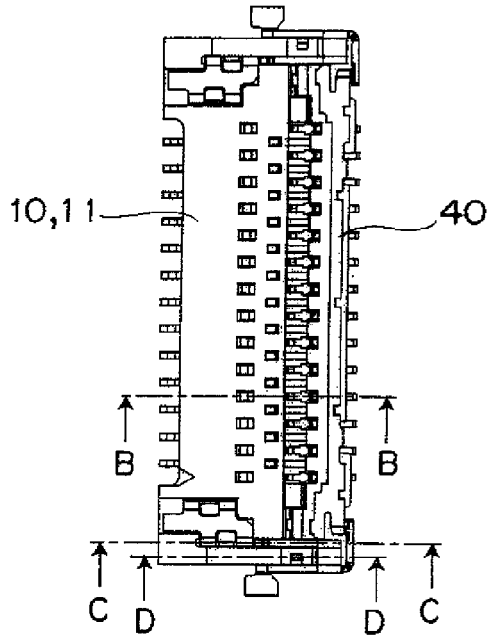
FIG. 20A, FIG. 20B, FIG. 20C and FIG. 20D are a plan view before the operation of the control lever, and a cross-sectional view along a B-B line, a cross-sectional view along a C-C line, and a cross-sectional view along a D-D line in FIG. 20A.
Figure 20B:
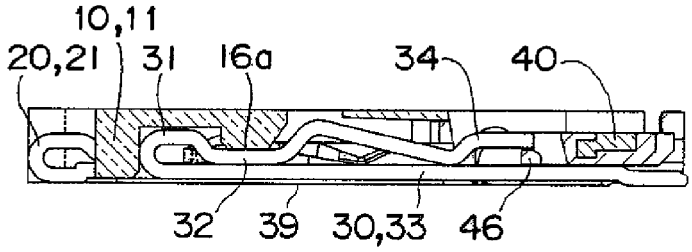
Figure 20C:
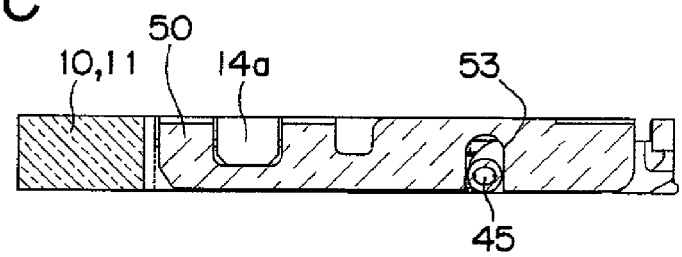
Figure 20D:
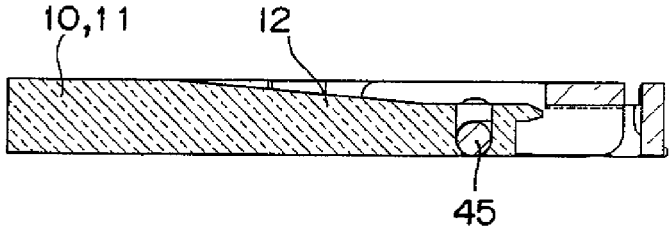
Figure 21A:
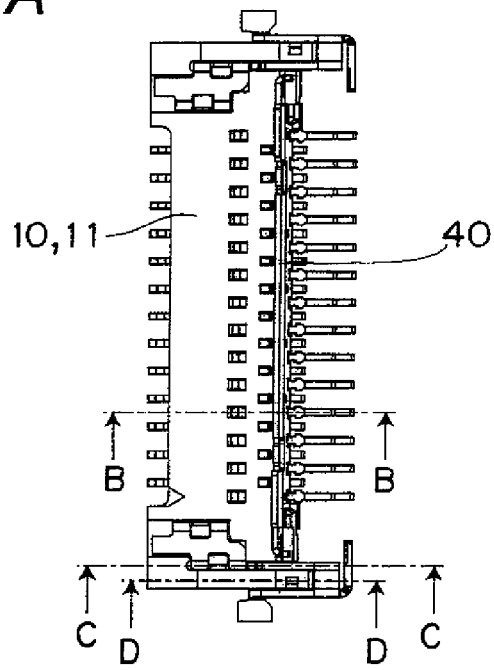
FIG. 21A, FIG. 21B, FIG. 21C and FIG. 21D are a plan view illustrating a state in which the control level is pulled up, and a cross-sectional view along a B-B line, a cross-sectional view along a C-C line, and a cross-sectional view along a D-D line in FIG. 21A.
Figure 21B:
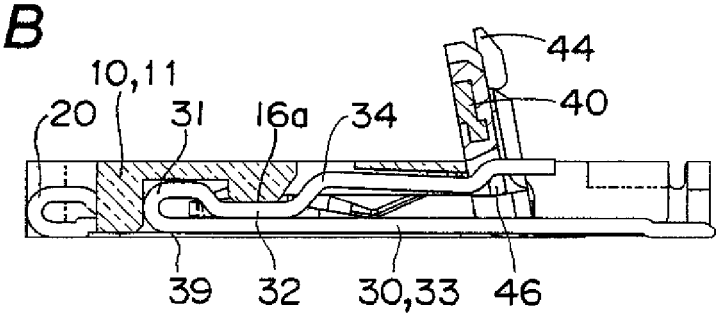
Figure 21C:
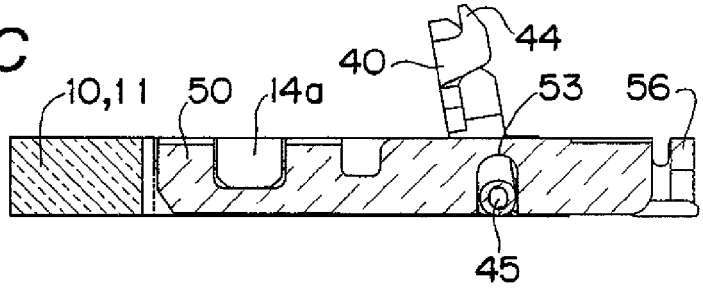
Figure 21D:
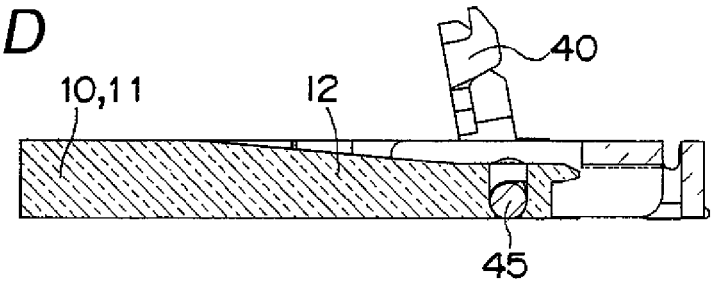

As shown in FIG. 20D, in the connector before the operation, the rotary shaft 45 of the control lever 40 is biased by the elastic arm portion 12 of the base 10 and located in the lowermost portion of the bearing groove 63 (FIG. 20C). As a result, the control lever 40 has no play. Further, the cam portion 46 of the control lever 40 is so designed that it is not in contact with the movable contact piece 34. This is done to prevent the occurrence of plastic deformation in the second connection terminal 30 and prevent the operation characteristics from changing under the effect of vibrations during transportation.

As shown in FIG. 21, when the control lever 40 of the connector is pulled up, the rotary shaft 45 of the control lever 40 rotates about the lowermost portion of the bearing groove 53 as a fulcrum. Because of this, the cam portion 46 of the control lever 40 pulls up the wider portion 35 of the second connection terminal 30, and the insertion portion 71 of the flexible printed board 70 can be inserted. At this time, because the cam portion 46 has a substantially square cross section, when the control lever 40 is pulled up to a predetermined position, a desired click feel can be obtained, thereby providing the operator with the sense of security.

Figure 17A:
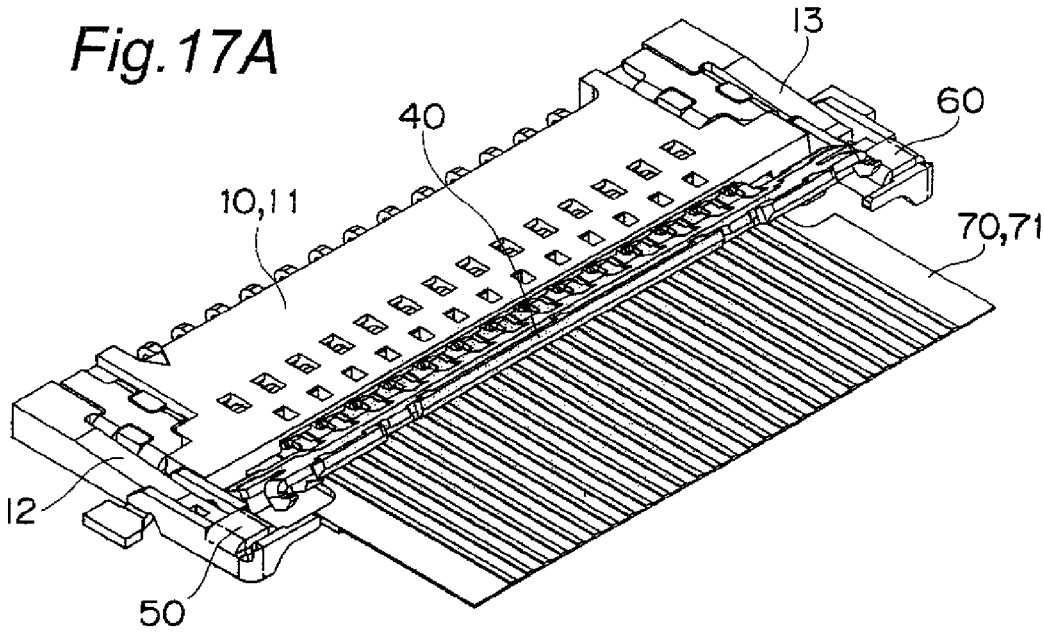
FIG. 17A and FIG. 17B are a perspective view and a partial enlarged perspective view immediately before the control lever is locked.
Figure 17B:
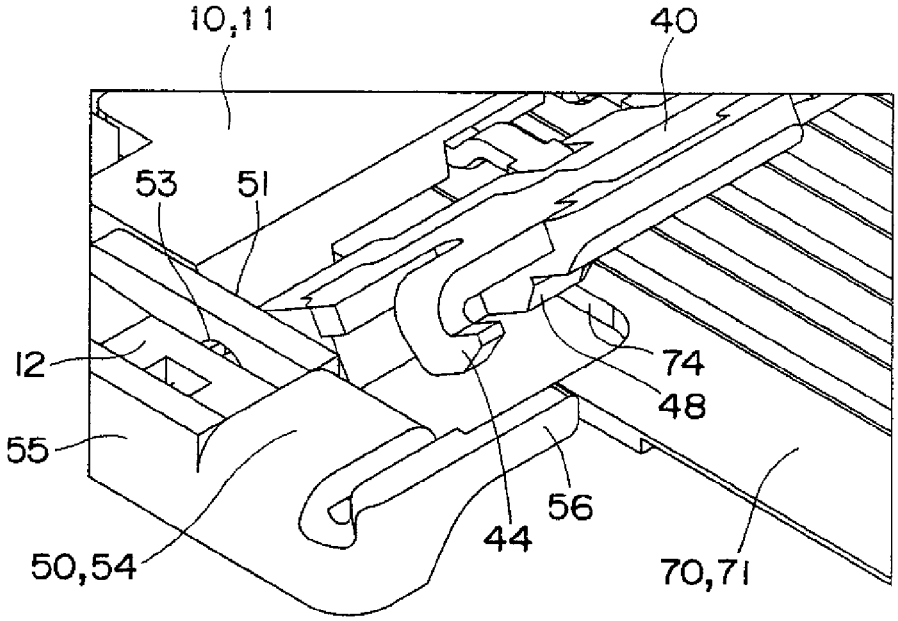
Figure 18A:
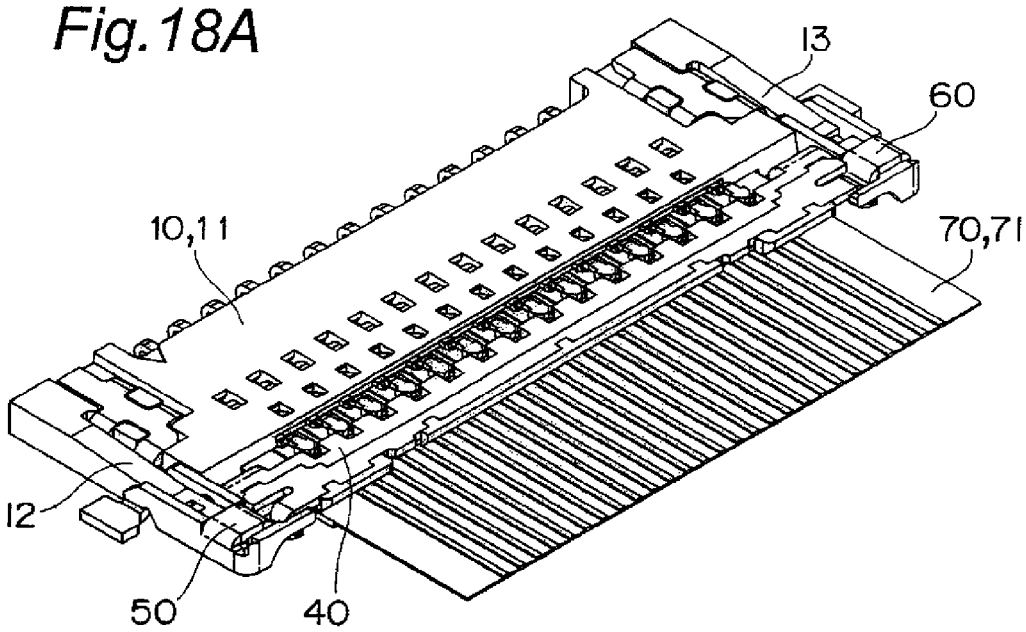
FIG. 18A and FIG. 18B are a perspective view and a partial enlarged perspective view of a state in which the control lever is locked.
Figure 18B:
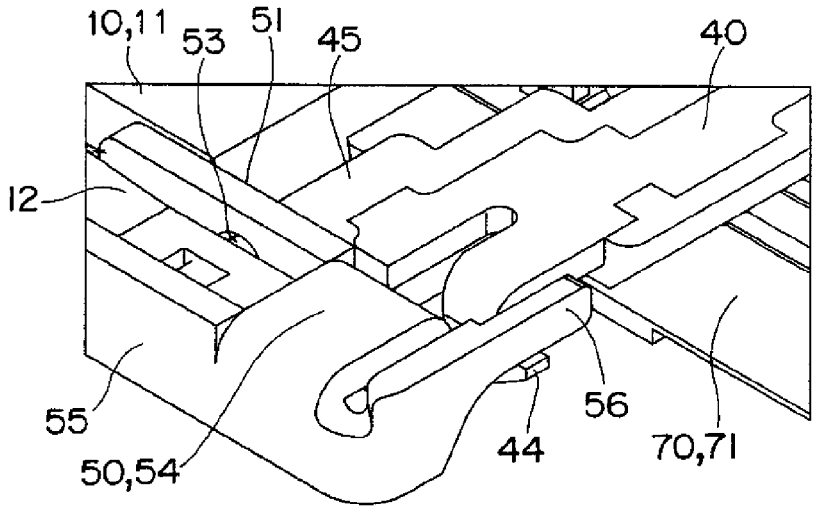

For example, where the insertion portion 71 of the flexible printed board 70 with a thickness of 0.09 mm is inserted along the terminal body portion 33 of the second connection terminal 30, the distal end of the insertion portion 71 abuts against, and is positioned by, the reference surface 17*a* for position control (FIG. 19B) formed in the rear surface of the base 10. Further, the first conductive portion 72 of the insertion portion 71 is pushed between the terminal body portion 23 of the first connection terminal 20 and the movable contact piece 24, and the second conductive portion 30 is positioned between the terminal body portion 33 of the second connection terminal 30 and the movable contact piece 34.

Where the control lever 40 is then brought down, the rotary shaft 45 of the control 40 that is mated with the bearing groove 53 is rotated and the cam portion 46 moves obliquely downward. For this reason, the movable contact piece 34 of the second connection terminal 30 pushes by its own spring force the second conductive portion 73 down and squeezes and electrically connects the second conductive portion 73 between the terminal body portion 33 of the second connection terminal 30 and the movable contact piece 34. When the control lever 40 is further rotated, as shown in FIG. 17 and FIG. 18, the locking hook portion 44 of the control lever 40 is locked by the locking protrusion 56 of the support clasp 50, thereby completing the connection operation. As a result, the blocking protrusions 48 formed at both ends of the lower surface of the control lever 40 are engaged with the notched portions 74 of the flexible printed board 70 and block the flexible printed board. At this time, the cam portion 46 of the control lever 40 is not pressed against the movable contact piece 34 of the connection terminal 30 and produces no effect on the contact pressure of the movable contact piece 34.

Figure 22A:
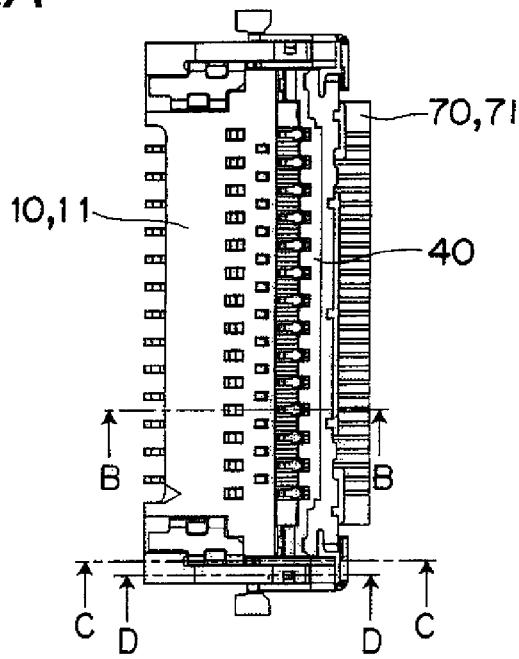
FIG. 22A, FIG. 22B, FIG. 22C and FIG. 22D are a plan view illustrating a state in which a flexible printed board is connected to the connector, and a cross-sectional view along a B-B line, a cross-sectional view along a C-C line, and a cross-sectional view along a D-D line in FIG. 22A.
Figure 22B:
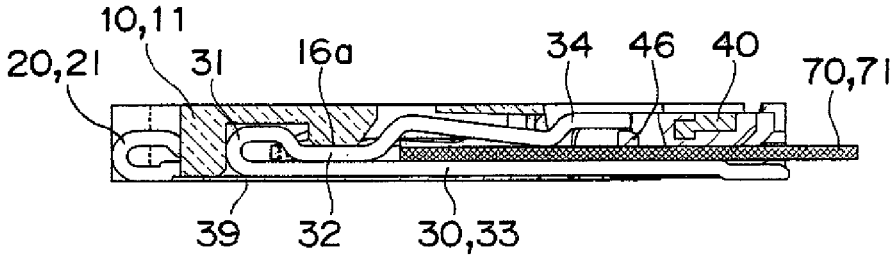
Figure 22C:
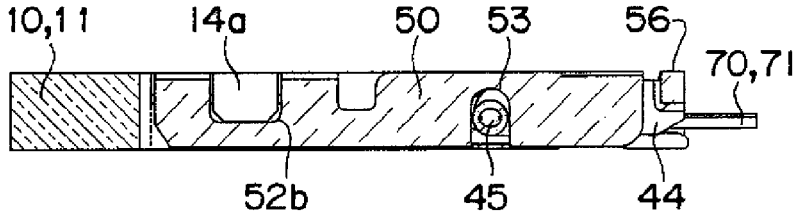
Figure 22D:
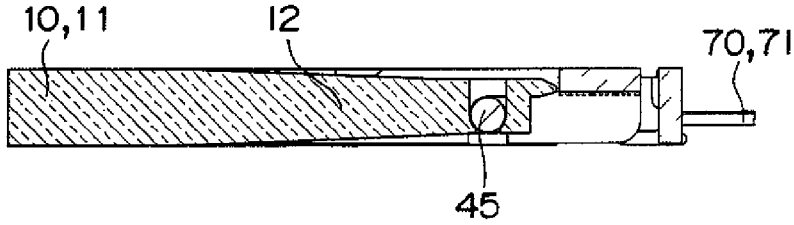

Further, as shown in FIG. 22C, the rotary shaft 45 of the control lever 40 does not return to the lowermost position of the bearing groove 53 and is stopped in the intermediate portion of the bearing groove 53. Because of this, as shown in FIG. 22D, the elastic arm portion 12 assumes a raised state. Therefore, a bias force of the elastic arm portion 12 acts upon the control lever 40, thereby preventing any play of the control lever 40.

Figure 23A:
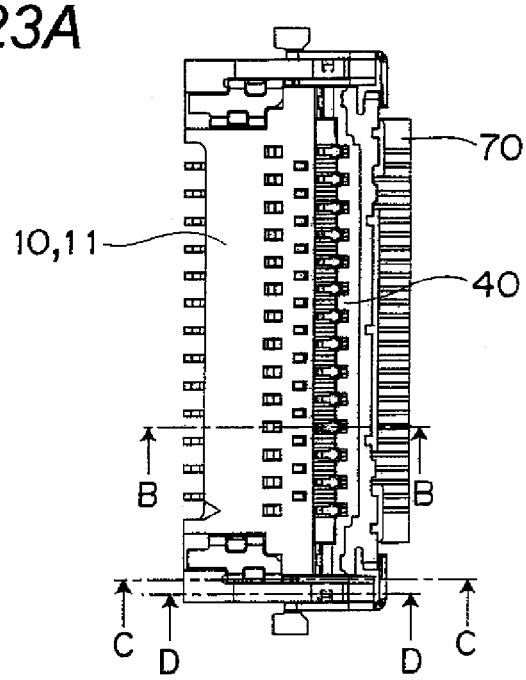
FIG. 23A, FIG. 23B, FIG. 23C and FIG. 23D are a plan view illustrating a state in which a flexible printed board of different thickness is connected to the connector, and a cross-sectional view along a B-B line, a cross-sectional view along a C-C line, and a cross-sectional view along a D-D line in FIG. 23A.
Figure 23B:
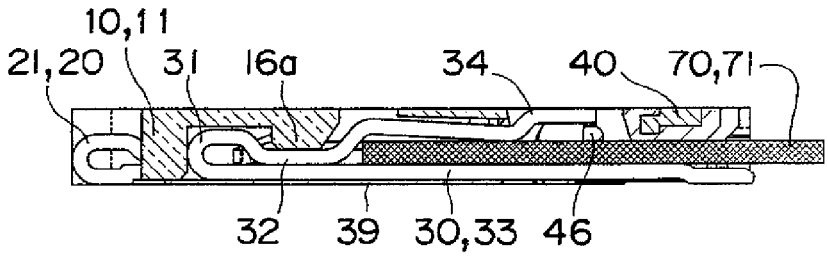
Figure 23C:
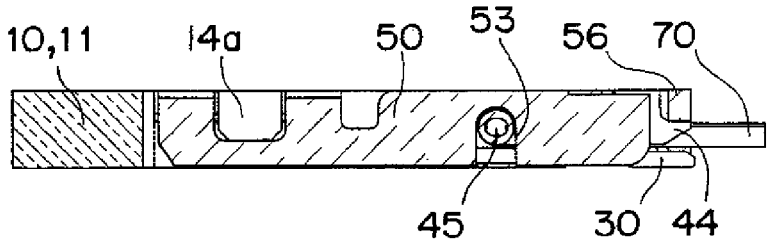
Figure 23D:
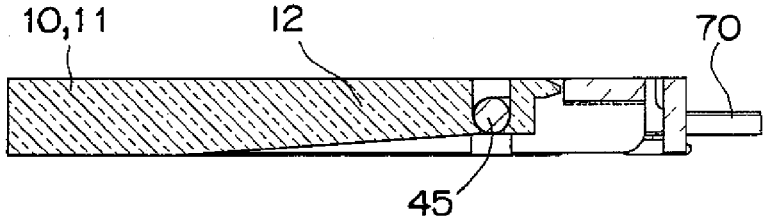

Likewise, as shown in FIG. 21, the control lever 40 is pulled up, and the insertion portion 71 of the flexible printed board 70 with a thickness of 0.15 mm is inserted. Further, as shown in FIG. 23C, where the control lever 40 is lowered and fixed, the rotary shaft 45 of the control lever 40 is stopped in the lowermost portion of the bearing groove 53 and does not move down. At this time, the cam portion 46 of the control lever 40 is not pressed against the movable contact piece 34 and produces no effect on the contact pressure. Further, because the elastic arm portion 12 is raised to the uppermost portion, as shown in FIG. 23D, a larger bias force of the elastic arm portion 12 acts upon the control lever 40, and play of the control lever 40 can be prevented more reliably.

In the present embodiment, the rotary shaft 45 of the control lever 40 is mated, so that it can slide in the vertical direction, with the bearing groove 53 of the support clasp 40. Because of this, flexible boards of different thickens can be inserted and connected. Furthermore, even when there is a spread in thickness of the flexible board 70, the control lever 40 produces no effect on contact pressure, and the movable contact pieces 24, 34 are pressed against the first and second conductive portions 72, 73 of the flexible board 70 by a predetermined contact pressure. Therefore, with the present embodiment, a connector of high utility and high contact reliability can be obtained.

Further, with the present embodiment, the soldering portions 57, 67 of the support clasps 50, 60 are connected to the ground wire of the printed board, and the metal core 41 of the control lever 40 is locked by the locking protrusions 56, 66 of the support clasps 50, 60 via the hook portions 44 for locking, thereby enabling magnetic shielding.

A case in which the control lever is attached via the support clasps to the base is explained above, but the present invention is not limited to such case. Thus, a configuration may be employed in which bearing grooves extending in the vertical direction are directly provided in extending portions that extend from end surfaces at both sides of the base, and the rotary shaft of the control lever can rotate in the bearing grooves and may be mated and supported so that it can slide in the vertical direction.

Further, in the present embodiment, a case is explained in which the connection terminal and support clasp that are components separate from the base are subsequently attached to the base, but such method is not limiting. Thus, the connection terminal may be insert molded with the base, or the support clasp may be insert molded with the base, or both the connection terminal and the support base may be insert molded with the base.

The connector in accordance with the present invention can be applied not only to a flexible printed board, but also to other printed boards.

What is claimed is:

1. A connector in which one end of a movable contact piece, which is in a pressed contact state against a terminal body portion of a connection terminal fixed to a base is lifted with a cam portion of a control lever in which rotatable shafts extending coaxially from end surfaces on both sides are rotatably supported on said base, and the portion of the control lever is not pressed against one end of the movable contact piece when the movable contact piece is pressed against the flexible circuit board, wherein bearing grooves extending in the vertical direction are provided in extending portions that extend from end surfaces on both sides of the base, and the rotary shafts of said control lever are mated with, and supported by, said bearing grooves rotatably and slidably in the vertical direction.

2. A connector in which one end of a movable contact piece, which is in a pressed contact state against a terminal body portion of a connection terminal fixed to a base is lifted with a cam portion of a control lever in which rotatable shafts extending coaxially from end surfaces on both sides are rotatably supported on said base, and the portion of the control lever is not pressed against one end of the movable contact piece when the movable contact piece is pressed against the flexible circuit board, wherein bearing grooves extending in the vertical direction are provided at a pair of support clasps that are attached to respective end surfaces on both sides of the base, and the rotary shafts of said control lever are mated with, and supported by, said bearing grooves rotatably and slidably in the vertical direction.

3. The connector according to claim 2, wherein a soldering portion is provided at the rear end of the extending portion that extends from a distal end portion of the support clasp via a connection portion, and a locking protrusion by which a locking hook portion of the control lever is locked is provided at the distal end of said extending portion.

4. The connector according to claim 3, wherein the locking hook portion extending from a metal core of the control lever that is insert molded can be locked by the locking protrusion of the support clasp.

* * * * *